US008480225B2

(12) United States Patent
Romano, Jr. et al.

(10) Patent No.: US 8,480,225 B2
(45) Date of Patent: Jul. 9, 2013

(54) INKJET RECORDING MEDIUM

(75) Inventors: Charles E. Romano, Jr., Wisconsin Rapids, WI (US); Rhonda G. Justice, Waverly, OH (US)

(73) Assignee: Newpage Corporation, Miamisburg, OH (US)

( * ) Notice: Subject to any disclaimer, the term of this patent is extended or adjusted under 35 U.S.C. 154(b) by 281 days.

(21) Appl. No.: 12/872,112

(22) Filed: Aug. 31, 2010

(65) Prior Publication Data

US 2011/0050827 A1 Mar. 3, 2011

Related U.S. Application Data

(60) Provisional application No. 61/238,428, filed on Aug. 31, 2009, provisional application No. 61/250,207, filed on Oct. 9, 2009.

(51) Int. Cl.
*B41J 2/01* (2006.01)

(52) U.S. Cl.
USPC ..... 347/105; 428/32.1; 347/101

(58) Field of Classification Search
USPC ..... 347/105, 101, 95, 96, 100; 428/195, 428/32.1
See application file for complete search history.

(56) References Cited

U.S. PATENT DOCUMENTS

| | | | |
|---|---|---|---|
| 1,941,001 | A | 12/1933 | Hansell |
| 3,197,322 | A | 7/1965 | Maskal et al. |
| 3,373,437 | A | 3/1968 | Sweet et al. |
| 3,416,153 | A | 12/1968 | Hertz et al. |
| 3,798,047 | A | 3/1974 | Delfosse |
| 3,878,519 | A | 4/1975 | Eaton |
| 4,346,387 | A | 8/1982 | Hertz |
| 4,714,603 | A | 12/1987 | Vanderheiden |
| 4,824,654 | A | 4/1989 | Ota et al. |
| 5,120,365 | A | 6/1992 | Kogler |
| 5,164,172 | A | 11/1992 | Katayama et al. |
| 5,269,818 | A | 12/1993 | Kunesh et al. |
| 5,296,002 | A | 3/1994 | Passaretti |
| 5,320,897 | A | 6/1994 | Kondo et al. |
| 5,332,564 | A | 7/1994 | Chapnerkar et al. |
| 5,418,057 | A | 5/1995 | Kokiyoshi et al. |
| 5,454,864 | A | 10/1995 | Whalen-Shaw |
| 5,478,388 | A | 12/1995 | Gane et al. |
| 5,676,746 | A | 10/1997 | Brown |
| 5,731,034 | A | 3/1998 | Husband |
| 5,846,382 | A | 12/1998 | Von Raven |
| 5,861,209 | A | 1/1999 | Haskins et al. |
| 5,879,442 | A | 3/1999 | Nishiguchi et al. |
| 5,882,396 | A | 3/1999 | Hiorns |
| 5,939,036 | A | 8/1999 | Porter et al. |
| 6,071,336 | A | 6/2000 | Fairchild et al. |
| 6,150,289 | A | 11/2000 | Chen et al. |
| 6,156,286 | A | 12/2000 | Fortier et al. |
| 6,207,258 | B1 | 3/2001 | Varnell |
| 6,221,146 | B1 | 4/2001 | Fortier et al. |
| 6,380,265 | B1 | 4/2002 | Pryor et al. |
| 6,402,824 | B1 | 6/2002 | Freeman et al. |
| 6,554,410 | B2 | 4/2003 | Jeanmaire et al. |
| 6,630,229 | B1 | 10/2003 | Normington et al. |
| RE38,301 | E | 11/2003 | Bleakley et al. |
| 6,677,386 | B1 | 1/2004 | Giezen et al. |
| 6,685,908 | B1 | 2/2004 | Yaniv |
| 6,780,920 | B2 | 8/2004 | Chapman et al. |
| 6,825,252 | B2 | 11/2004 | Helbling et al. |
| 6,841,609 | B2 | 1/2005 | Chapman et al. |
| 6,863,775 | B2 | 3/2005 | Bobsein et al. |
| 6,921,430 | B2 | 7/2005 | Bloembergen et al. |
| 7,014,893 | B2 | 3/2006 | Wicher et al. |
| 7,285,586 | B2 | 10/2007 | Helbling et al. |
| 7,393,571 | B2 | 7/2008 | Chapman et al. |
| 7,452,592 | B2 | 11/2008 | Cowton |
| 7,803,224 | B2 | 9/2010 | Schliesman et al. |
| 2003/0099816 | A1 | 5/2003 | Liu et al. |
| 2003/0180478 | A1* | 9/2003 | Fruge et al. ..... 428/31 |
| 2003/0191226 | A1* | 10/2003 | Chapman et al. ..... 428/304.4 |
| 2003/0203133 | A1 | 10/2003 | Maekawa |
| 2004/0255820 | A1 | 12/2004 | Chen et al. |
| 2005/0003113 | A1* | 1/2005 | Chen et al. ..... 428/32.18 |
| 2006/0054291 | A1 | 3/2006 | Dimmick et al. |
| 2006/0060317 | A1 | 3/2006 | Roding et al. |
| 2006/0098066 | A1 | 5/2006 | Bauer |

(Continued)

FOREIGN PATENT DOCUMENTS

| | | | |
|---|---|---|---|
| EP | 1114735 | A2 | 7/2001 |
| EP | 2196320 | A1 | 6/2010 |

(Continued)

OTHER PUBLICATIONS

PCT, International Search Report and Written Opinion, PCT/US2010/047231 (Dec. 9, 2010).

PCT, International Preliminary Report on Patentability, PCT/US2010/047231 (Mar. 15, 2012).

Svanholm, Eric., "Printability and Ink-Coating Interactions in Inkjet Printing", Faculty of Technology and Science Chemical Engineering, Dissertation, Karlstad University Studies, 2007:2.

Press Release, Kodak Focuses on Delivering Offset Class Quality, Providing Scaleable Solutions with Inkjet Printing Systems (Jan. 17, 2008).

Svanholm, "An Experimental Study of Inkjet Receptive Coatings" (Nov. 15, 2004).

(Continued)

*Primary Examiner* — Manish S Shah

(74) *Attorney, Agent, or Firm* — Thompson Hine L.L.P.

(57) ABSTRACT

An inkjet recording medium including: a coated paper substrate; and an inkjet-receptive coating applied to at least one side of the coated paper wherein the inkjet-receptive coating includes inorganic oxide particles, a multivalent metal salt and a binder; wherein said inorganic oxide particles includes a cationic porous silica having an average particle size less than 0.5 microns and a pore volume of at least 0.70 ml/g and a surface area less than 200 $m^2/g$, and said inkjet recording medium has a 75° gloss of at least 60.

23 Claims, No Drawings

U.S. PATENT DOCUMENTS

| | | | | |
|---|---|---|---|---|
| 2006/0099408 | A1 | 5/2006 | Andersson et al. | |
| 2006/0102304 | A1 | 5/2006 | Nutbeem et al. | |
| 2006/0112855 | A1 | 6/2006 | Andersson et al. | |
| 2006/0137574 | A1 | 6/2006 | Preston et al. | |
| 2006/0159910 | A1 | 7/2006 | Song et al. | |
| 2006/0272549 | A1 | 12/2006 | Mathur et al. | |
| 2006/0292305 | A1 | 12/2006 | Skuse et al. | |
| 2007/0237909 | A1 | 10/2007 | McManus | |
| 2008/0008846 | A1 | 1/2008 | Zhou et al. | |
| 2008/0032074 | A1 * | 2/2008 | Doi et al. | 428/34.1 |
| 2008/0268185 | A1 * | 10/2008 | Chen et al. | 428/32.24 |
| 2009/0035478 | A1 | 2/2009 | Zhou et al. | |
| 2009/0074995 | A1 | 3/2009 | Dannhauser et al. | |
| 2009/0087568 | A1 | 4/2009 | Kobayashi | |
| 2009/0123675 | A1 | 5/2009 | Shaw-Klein et al. | |
| 2009/0131570 | A1 | 5/2009 | Schliesman et al. | |
| 2009/0169455 | A1 | 7/2009 | Van Aert et al. | |
| 2011/0037818 | A1 | 2/2011 | Romano, Jr. et al. | |
| 2011/0069106 | A1 | 3/2011 | Song et al. | |
| 2012/0154502 | A1 | 6/2012 | Romano, Jr. et al. | |
| 2012/0212555 | A1 | 8/2012 | Romano, Jr. | |

FOREIGN PATENT DOCUMENTS

| | | | |
|---|---|---|---|
| WO | 03/031191 | A2 | 4/2003 |
| WO | 03/031191 | A3 | 4/2003 |
| WO | 2004/061014 | A1 | 7/2004 |
| WO | 2006/116878 | A1 | 11/2006 |
| WO | 2007/112013 | A2 | 10/2007 |
| WO | 2009/095697 | A1 | 8/2009 |
| WO | 2010/065750 | | 6/2010 |
| WO | 2010/114560 | | 10/2010 |
| WO | 2011/019866 | | 2/2011 |
| WO | 2012/083015 | | 6/2012 |

OTHER PUBLICATIONS

Product Information, "SYLOJET® C30 Cationic Porous Silica Dispersion for Ink Jet and Other Functional Coatings," W.R. Grace & Co. (Mar. 26, 2009).

Product Information, "HYDRAGLOSS® 90 Kaolin Clay," KaMin Performance Minerals (2009).

Product Information, "HYDRAFINE® Kaolin Clay," KaMin Performance Minerals (2009).

Hugener, P. et al., "A New Coating Ground Calcium Carbonate for Enhanced Paper Properties" (Apr. 26, 2010).

Dimmick, A.C., "Effects of Sheet Moisture and Calender Pressure on PCC and GCC Coated Papers," TAPPI Journal (Nov. 2007).

Wilson, I., "Filler and Coating Pigments and Papermakers," *Industrial Minerals & Rocks: Commodities, Markets, and Uses*, 7th Edition, pp. 1287-1300 (2006).

"Formulation Guide for ECOSPHERE® Biolatex Binders," by EcoSynthetix Inc. (2010).

"Technical Data Sheet. ECOSPHERE® 2240 biolatex® binder for coated paper and paperboard," by EcoSynthetix Inc. (2010).

"Handling Options for EcoSphere® Biolatex® Binders," by EcoSynthetix (date of first publication unknown).

Lee, D.I. et al., "Development of New Biobased Emulsion Binders," presented at TAPPI PaperCon 2010, Talent, Technology and Transformation, Atlanta, GA (May 2-5, 2010).

* cited by examiner

INKJET RECORDING MEDIUM

CROSS REFERENCE TO RELATED APPLICATIONS

This application claims the benefit of U.S. Provisional App. Ser. No. 61/250,207, filed Oct. 9, 2009 and U.S. Provisional App. Ser. No. 61/238,428, filed Aug. 31, 2009, the entire contents of which are hereby incorporated by reference.

BACKGROUND

The present application relates to an inkjet recording medium and a coating composition for forming a glossy inkjet recording medium. More specifically, the inkjet recording medium disclosed herein is particularly useful for high speed printing such as high speed inkjet printing.

Traditionally, commercial printing presses printed catalogs, brochures and direct mail using offset printing. However, advances in inkjet technology have led to increased penetration into commercial print shops. Inkjet technology provides a high-quality alternative to offset printing for improving response rates, reducing cost, and increasing demand for products. In addition to printing high quality variable images and text, these printers incorporate a roll-fed paper transport system that enables fast, high-volume printing. Inkjet technology is now being used to for on-demand production of local magazines, newspapers, small-lot printing, textbooks, and transactional printing world wide.

In accordance with certain aspects of the present invention, a recording medium is described which provides fast drying times, high gloss and excellent image quality when printed using high speed inkjet devices used in commercial printing applications.

U.S. Pat. App. Pub. No. 2009/0131570 entitled "Paper and Coating Medium for Multifunction Printing" (Schliesman, et al.) discloses an inkjet recording medium that is compatible with offset, inkjet, and laser printing. In accordance with certain aspects, the formulation for this medium comprises an anionic primary pigment having a particle size distribution where at least 96% of the particles by weight have a particle size less than 2 microns; at least one cationic, grit free, secondary pigment having an average particle size of 3 microns or less; up to 17 weight % latex based on the weight of the dry pigments, wherein the latex is a hydrophilic styrene/butadiene latex; and a co-binder. While this formulation works well with many commercial inkjet printers, it performs poorly with some high speed inkjet printers using pigmented inks. The contents of the '570 publication are hereby incorporated by reference.

SUMMARY

The present application describes an inkjet recording medium and a coating composition for forming an inkjet recording medium. In accordance with one aspect of the present invention, an inkjet recording medium is disclosed comprising an inkjet-receptive coating on a coated paper substrate. The inkjet-receptive coating contains inorganic oxide particles, a multivalent metal salt and a binder such that the inkjet recording medium exhibits improved inkjet print properties, particularly when printed with a high speed inkjet printer using some pigmented inks. In accordance with certain aspects of the present invention, the multivalent metal salt may be provided as a separate top coat on a layer containing the binder and inorganic oxide particles.

In accordance with certain embodiments, the coated paper substrate comprises a sheet having a base coating that includes a fine particle size clay. In some cases, the clay includes particles having a particle size distribution where at least 90% of the particles by weight have a particle size less than 2 microns. The base coating may also include other pigments such as calcium carbonate.

Another embodiment of this invention relates to a method of printing comprising depositing inkjet ink on the recording medium described herein. The recording medium is highly absorbent for many types of ink. It quickly absorbs ink from several passes of an inkjet printer.

The coating and coated paper of the instant invention are particularly useful with pigmented inkjet inks.

DETAILED DESCRIPTION

The coating for producing the inkjet receptive coating typically includes inorganic oxide particles and a multivalent metal salt. The inorganic oxide may be a cationic porous silica dispersion of a median particle size below about 0.5 microns. Further, the coating typically includes a binder. In some cases, pigments comprise the largest portion of the coating composition on a dry weight basis. In other cases, the multivalent metal salt may constitute the largest portion of the coating composition. Unless otherwise noted, amounts of component materials are expressed in terms of component parts per 100 parts of total pigment on a weight basis.

The inorganic oxide of the coating may be a cationic pigment having a small particle size where the particles are less than 0.5 microns in diameter. In accordance with certain embodiments, the inorganic oxide is from about 65 to about 100 parts, more particularly from about 70 to about 95 parts, of the total pigment by weight in the inkjet-receptive coating. In accordance with certain embodiments, the inorganic oxide particles account for substantially all of the pigments in the coating. As used herein, the term "substantially all" indicates that the inorganic oxide pigments account for at least about 98%, more particularly at least 99% and in certain embodiments at least 99.5% of the pigments in the coating composition.

Examples of inorganic oxide particles that are useful in producing the inkjet-receptive coating are described in U.S. Pat. No. 7,393,571, the contents of which are hereby incorporated by reference. The inorganic oxide particles may be modified to improve the properties of the particles. The inorganic particles can be modified to create particles exhibiting positive surface charge (zeta potential). The surface charge may have a zeta potential of at least +20 mV, and in certain cases at least +40 mV. The particles can be modified by additives having a cationic moiety and can be modified, for example, with alumina, organic cation-containing silanes, and ionic polymers.

In accordance with certain aspects of the present invention, the inorganic oxide particles comprise a cationic porous silica dispersion such as SyloJet® C30 or C30F (Grace Davison). In accordance with certain aspects of the present invention, the inorganic oxide particles have an average particle size between about 0.2 and 0.4 microns, a pore volume ($N_2$) of at least 0.70 ml/g and a surface area of less than 200 $m^2$/g. In accordance with other embodiments, the total pore volume of the particles as measured on a dry basis is in the range of about 0.5 to about 2.0 ml/g, more particularly from about 0.5 to 1.5 and in certain embodiments from about 0.7 to 1.2 ml/g.

Binders suitable for use in the inkjet-receptive coating include water soluble or water dispersible polymers capable of binding the inorganic particles. Particularly useful polymers include polyvinyl alcohol, polyvinyl alcohol derivatives and modified polyvinyl alcohol. Specific examples of polyvinyl alcohols that can be utilized in certain aspects of the present invention include Celvol-2035 from Celanese and Poval-235.

Other suitable binders include hydroxyethyl cellulose, hydroxypropyl cellulose, hydroxyethylmethyl cellulose, hydroxypropyl methyl cellulose, hydroxybutylmethyl cellulose, methyl cellulose, sodium carboxymethyl cellulose, sodium carboxymethylhydroxethyl cellulose, water soluble ethylhydroxyethyl cellulose, cellulose sulfate, polyvinyl acetate, polyvinyl acetal, polyvinyl pyrrolidone, polyacrylamide, acrylamide/acrylic acid copolymer, polystyrene, styrene copolymers, acrylic or methacrylic polymers, styrene/acrylic copolymers, ethylene-vinylacetate copolymer, vinylmethyl ether/maleic acid copolymer, poly(2-acrylamido-2-methyl propane sulfonic acid), poly(diethylene triamine-co-adipic acid), polyvinyl pyridine, polyvinyl imidazole, polyethylene imine epichlorohydrin modified, polyethylene imine ethoxylated, polyethylene oxide, polyurethane, melamine resins, gelatin, carrageenan, dextran, gum arabic, casein, pectin, albumin, starch, collagen derivatives, collodion and agar-agar.

The inkjet-receptive coating also includes a multivalent metal salt. In certain embodiments of the invention, the multivalent metal is a divalent or trivalent cation. More particularly, the multivalent metal salt may be a cation selected from $Mg^{+2}$, $Ca^{+2}$, $Ba^{+2}$, $Zn^{+2}$, and $Al^{+3}$, in combination with suitable counter ions. Divalent cations such as $Ca^{+2}$ and $Mg^{+2}$ are particularly useful. Combinations of cations may also be used.

Examples of the salt used in the invention include (but are not limited to) calcium chloride, calcium acetate, calcium nitrate, magnesium chloride, magnesium acetate, magnesium nitrate, magnesium sulfate, barium chloride, barium nitrate, zinc chloride, zinc nitrate, aluminum chloride, aluminum hydroxychloride, and aluminum nitrate. Similar salts will be appreciated by the skilled artisan. Particularly useful salts include $CaCl_2$, $MgCl_2$, $MgSO_4$, $Ca(NO_3)_2$, and $Mg(NO_3)_2$, including hydrated versions of these salts. Combinations of the salts may also be used.

In accordance with certain aspects of the present invention, the multivalent metal salt is used in an amount from about 20 to 150, more particularly from about 35 to about 133 parts per 100 parts pigment. In accordance with certain aspects of the present invention, the multivalent metal salt is provided as a separate layer in the inkjet-receptive coating that is provided as a top coating over a layer containing the inorganic oxide and binder.

The inkjet-receptive coating may also include optional additives such as colorants, thickeners, release agents, flow modifiers, conventional pigments, fume silicas, brightening agents, surfactants, and/or dispersants as required. The amount of the additives to be included in the formulation can be readily determined by one of ordinary skill in the art.

The inkjet-receptive coating is typically applied in an amount sufficient to provide the desired gloss and image quality. Typically, the inkjet-receptive coating is applied at a coat weight from about 0.15 lbs to about 2 lb. dry, more particularly from about 0.5 to 1.5 lb. Coat weights are provided on a lb./ream basis for a ream size of 3,300 $ft^2$.

In accordance with certain aspects of the present invention, the inkjet receptive coating is coated on a base coated paper substrate wherein the finished paper has a 75° gloss of at least 60, at least 70 or in some cases at least 75.

The base coated paper substrate is typically coated on each side of the paper substrate. The base coating typically is applied in the range of about 5-12 lbs./ream, more particularly from about 8-10 lbs./ream depending on the substrate, base coating and target gloss.

In accordance with certain embodiments, the base coating contains a fine particle size clay. The clay may include particles having a particle size distribution wherein at least 90%, more particularly at least 96%, of the particles by weight have a particle size less than 2 microns. The fine particle size clay may account for about 20-80 parts of the coating pigment on a dry weight basis. In certain embodiments, the clay is from about 40 to 60 parts based on 100 parts total pigment. HYDRAGLOSS® 90 Kaolin clay (KaMin) is an example of a particularly useful clay that provides coatings exhibiting desirable properties.

The base coating may also contain other pigments, particularly fine size pigments. Examples of other pigments that may be used include carbonates, silicates, silicas, titanium dioxide, aluminum oxides and aluminum trihydrates. Additional pigments may be included in the base coating as needed to improve gloss, whiteness or other coating properties. These pigments may be used in amounts up to an additional 60 parts by weight of the dry coating pigment. Up to 40 parts, more particularly less than 30 parts, of the pigment may be a coarse ground calcium carbonate, fine ground calcium carbonate, plastic pigment, $TiO_2$, or mixtures thereof. An example of a ground calcium carbonate is Carbital 35 calcium carbonate (Imerys, Roswell, Ga.). Another supplemental pigment is anionic titanium dioxide, such as that available from Itochu Chemicals America (White Plains, N.Y.). Hollow spheres are particularly useful plastic pigments for paper glossing. Examples of hollow sphere pigments include ROPAQUE 1353 and ROPAQUE AF-1055 (Rohm & Haas, Philadelphia, Pa.). Higher gloss papers are obtainable when fine pigments are used that have a small particle size. The relative amounts of these pigments may be varied depending on the whiteness and desired gloss levels.

A binder may be included in the base coating for adhesion. The binder may be anionic and in certain embodiments is a styrene/butadiene latex ("SBR Latex"). Optionally, the latex co-polymer also includes up to 20% by weight acrylonitrile repeating units. SBR Latex is a carboxylated styrene butadiene copolymer latex admixture and may contain acrylonitrile. Highly hydrophilic polymers may be used. Examples of useful polymers include Genflo 5915 SB Latex polymer, Genflo 5086 SB Latex polymer, Gencryl PT 9525 latex polymer, and Gencryl 9750 ACN Latex polymers (all available from RohmNova, Akron, Ohio). The total amount of binder in the base coating layer typically is from about 2 to about 20, more particularly from about 5 to about 15, parts per 100 parts of total pigments.

The base coating may also include a co-binder that is used in addition to the primary binder. Examples of useful co-binders include polyvinyl alcohol and protein binders. The co-binder typically is used in amounts of about 1 to about 4 parts co-binder per 100 parts of pigment on a dry weight basis, more particularly from about 1.5 to 3 parts co-binder per 100 parts dry pigment. Another co-binder that is useful in some embodiments is starch. Both cationic and anionic starches may be used as a co-binder. ADM Clineo 716 starch is an ethylated cornstarch (Archer Daniels Midland, Clinton, Iowa). Penford PG 260 is an example of another starch co-binder that can be used. If a cationic co-binder is used, the amount used may be limited so that the overall anionic nature of the coating is maintained. The binder levels should be carefully controlled. If too little binder is used, the coating structure lacks physical integrity, while if too much binder is used, the coating becomes less porous resulting in longer ink drying times.

Other optional additives may be used to vary properties of the inkjet-receptive coating or the base coating. Brightening agents, such as Clariant T26 Optical Brightening Agent, (Clariant Corporation, McHenry, Ill.) can be used. Insolubilizers or cross-linkers may be useful. A particularly useful cross-linker is Sequarez 755 (RohmNova, Akron, Ohio). The amount of crosslinker or insolubilizer may be in the range of 0.1-1.0, more particularly from about 0.2 to 0.6 parts by weight based on 100 parts total pigment. A lubricant is optionally added to reduce drag when the coating is applied with a blade coater.

Conventional mixing techniques may be used in making the coating. If starch is used, it is cooked prior to preparing the coating using a starch cooker. In accordance with certain embodiments, the starch may be made down to approximately 35% solids. Separately, all of the pigments, including the primary pigment, secondary and any supplemental pigments, may be mixed for several minutes to ensure no settling has occurred. In the laboratory, the pigments may be mixed on a drill press mixer using a paddle mixer. The primary binder is then added to the mixer, followed by the co-binder 1-2 minutes later. If starch is used, it is typically added to the mixer while it is still warm from the cooker, approximately 190° F. The final coating is made by dispersion of the mixed components in water. Solids content of the dispersion typically is from about 55% to about 68% by weight. More particularly, the solids are about 58% to about 62% of the dispersion by weight.

Yet another embodiment relates to a high gloss inkjet recording medium having an inkjet receptive coating on at least one surface of a base coated sheet. Any coating method or apparatus may be used, including, but not limited to, roll coaters, jet coaters, curtain coaters, blade coaters or rod coaters. Inkjet recording medium in accordance with certain aspects would typically range from about 30 lb. to about 250 lb./3,300 ft.$^2$ of paper surface. The coated paper is then optionally finished as desired to the desired gloss.

The substrate or base sheet may be a conventional coated base sheet. Examples of useful base sheets include Productolith/Sterling Gloss 80#, Sterling Ultra Matte Text 80#, Fortune Matte Cover, Futura Laser High Gloss 146#, and Centura Gloss 80#.

The finished inkjet recording medium is useful for printing. Ink is applied to the inkjet recording medium to create an image. After application, the ink vehicle penetrates the coating and is absorbed therein. The number and uniformity of the coating pores result in even and rapid ink absorption. This inkjet recording medium may also be well suited for multifunctional printing, whereby an image on a coated paper media is created from combinations of dyes or pigmented inks from inkjet printers, toner from laser printers and inks from offset or gravure or flexo presses.

The following non-limiting examples illustrate specific aspects of the present invention.

A coating comprising 133.3 parts calcium chloride, 100 parts SyloJet® C30F, a micronized silica gel surface treated with aluminum chloride (Grace Davison), and 40 parts Celvol 203 (polyvinyl alcohol) was coated on commercially available coated offset papers at a dry weight of 1 lb./ream by means of a blade coater. The coatings were calendered at 1200 PLI/100° F. using 3 nips/side. Control samples without the inkjet receptive coating were prepared by subjecting the commercially available offset papers to the same calendering conditions set forth above.

A test target was printed on the resulting paper with a Kodak 5300 printer containing standard Kodak pigmented inks. The test target comprised Dmax black, magenta, cyan, yellow, red, green, and blue patches. The red, green and blue patches were measured for mottle using a Personal IAS Image Analysis System manufactured by QEA and optical density was measured with a densitometer. Mottle is a density non-uniformity that occurs at a low spatial frequency (i.e., noise at a coarse scale). The units of mottle are percent reflectance using the default density standard and color filter specified in the software. A lower mottle value indicates better performance. The mottle result below is the average of mottle of the red, green, and blue patches. Gloss was measured at 75 degrees.

A lower mottle value indicates better performance. The mottle result below is the average of mottle of the black, magenta, cyan, yellow, red, green, and blue patches. In accordance with certain aspects of the present invention, mottle values of less than 3.0, more particularly less than 2.0, still more particularly less than 1.5, and in certain cases less than 1.0 can be obtained.

Table 1 illustrates the superior mottle of the inventive examples compared to the control examples with no inkjet receptive coating. Both the inventive examples and the control examples were calendered using the same calendering conditions.

TABLE 1

| Examples | Base Paper | Coated* | Gloss Calendered | Mottle | Gloss/Mottle |
|---|---|---|---|---|---|
| Invention Ex. 1 | A | Yes | 41.6 | 0.56 | 74 |
| Invention Ex. 2 | B | Yes | 76.4 | 0.51 | 150 |
| Invention Ex. 3 | C | Yes | 67.4 | 0.73 | 92.3 |
| Invention Ex. 4 | D | Yes | 72.1 | 0.54 | 134 |
| Invention Ex. 5 | E | Yes | 70.8 | 0.49 | 145 |
| Invention Ex. 6 | F | Yes | 59.9 | 0.54 | 111 |
| Invention Ex. 7 | G | Yes | 68.8 | 0.63 | 109 |
| Invention Ex. 8 | H | Yes | 74.3 | 0.59 | 126 |
| Control Ex. 1 | A | No | 40.5 | 2.31 | 17.5 |
| Control Ex. 2 | B | No | 81.4 | 5.55 | 14.7 |
| Control Ex. 3 | C | No | 68.6 | 4.26 | 16.1 |
| Control Ex. 4 | D | No | 79.4 | 5.10 | 15.6 |
| Control Ex. 5 | E | No | 77.0 | 6.39 | 12.1 |
| Control Ex. 6 | F | No | 74.6 | 3.47 | 21.5 |
| Control Ex. 7 | G | No | 78.1 | 2.60 | 30.0 |
| Control Ex. 8 | H | No | 76.7 | 4.34 | 17.7 |

*Coated with inkjet-receptive coating.

The gloss/mottle ratio in accordance with certain aspects of the present invention is at least 100, more particularly at least 110, still more particularly at least 120, at least 130, and in certain cases at least 140.

Alternatively, the calcium chloride can be applied as a separate 5% washcoat over a layer containing the silica gel and binder. Table 2 shows the improvement in gloss mottle obtained by applying a separate washcoat of calcium chloride.

TABLE 2

| Examples | Base Paper | Wash Coated | Gloss | Mottle |
|---|---|---|---|---|
| Invention Ex. 9 | H | Yes | 66.4 | 1.86 |
| Control Ex. 9 | H | No | 65.9 | 6.37 |

Table 3 shows the effect of the inkjet-receptive coating on the gloss of the paper.

TABLE 3

| Base Paper | Gloss Uncoated Calendered | Gloss Coated Calendered | % Gloss Difference |
|---|---|---|---|
| A | 40.5 | 41.6 | 1.1 |
| B | 81.4 | 76.4 | −5.0 |
| C | 68.6 | 67.4 | −1.2 |
| D | 79.4 | 72.1 | −7.3 |
| E | 77.0 | 70.8 | −6.2 |
| F | 74.6 | 59.9 | −14.7 |
| G | 78.1 | 68.8 | −9.3 |
| H | 76.7 | 74.3 | −2.4 |

With the exception of base paper A, a loss of gloss was observed when the inkjet receptive coating was applied. The effect was most pronounced with base paper F where a 14.7% delta was observed.

Coated and uncoated sheets were printed with a Kodak Easy share printer and mottle was measured on 100% fill R, G, B, C, M, Y, K patches using a QEA Personal IAS image analyzer. As shown in Table 4, a significant difference was observed for mottle between the coated and uncoated samples. Of the uncoated samples, papers A and G had the best results. The application of the inkjet receptive coating normalizes the performance of the base papers.

TABLE 4

| Base Paper | Mottle Coated | Mottle Uncoated | Mottle Difference |
|---|---|---|---|
| A | 0.56 | 2.31 | 1.8 |
| B | 0.51 | 5.55 | 5.0 |
| C | 0.73 | 4.26 | 3.5 |
| D | 0.54 | 5.10 | 4.6 |
| E | 0.49 | 6.39 | 5.9 |
| F | 0.54 | 3.47 | 2.9 |
| G | 0.63 | 2.60 | 2.0 |
| H | 0.59 | 4.34 | 3.8 |

Table 5: Inkjet-Receptive Coating Formulation Examples

TABLE 5

| Generic Material | Narrow Range | Broad Range | Example Material |
|---|---|---|---|
| | Dry Parts | Dry Parts | |
| Inorganic Oxide | 70-95 | 65-100 | SyloJet C30F |
| Multivalent salt | 35-133 | 20-150 | Calcium Chloride |
| Binder | 7-15 | 3-50 | Poval-235 |
| Crosslinker | 0.2-0.6 | 0.05-1.0 | Sequarez 755 |

What is claimed is:

1. An inkjet recording medium comprising:

a coated paper substrate; and an inkjet-receptive coating applied to at least one side of said coated paper wherein said inkjet-receptive coating comprises inorganic oxide particles, a multivalent metal salt and a binder; wherein said inorganic oxide particles comprise a cationic porous silica having an average particle size less than 0.5 microns and a pore volume ($N_2$) of at least 0.70 ml/g and a surface area less than 200 $m^2$/g, and said inkjet recording medium has a 75° gloss of at least 60.

2. The inkjet recording medium of claim 1 wherein the silica particles have a median particle size of about 0.2 to 0.5 microns.

3. The inkjet recording medium of claim 1 wherein said medium has a mottle value of less than 3.0 when printed with an inkjet printer containing pigmented inks.

4. The inkjet recording medium of claim 1 wherein said binder comprises a polyvinyl alcohol.

5. The inkjet recording medium of claim 1 wherein said coating further comprises a crosslinker.

6. The inkjet recording medium of claim 1 wherein said binder is present in an amount of about 3 to 50 parts based on 100 parts total pigments.

7. The inkjet recording medium of claim 1 wherein said inorganic oxide particles account for substantially all of the pigments in the coating.

8. The inkjet recording medium of claim 1 wherein said inkjet receptive coating is present at a coat weight of about 0.15 to 1.0 lbs./ream (3,300 $ft.^2$).

9. The inkjet recording medium of claim 1 wherein the multivalent metal salt is present in an amount of about 35 to 133 parts based on 100 parts total pigments.

10. The inkjet recording medium of claim 1 wherein the multivalent metal salt comprises a cation selected from the group consisting of $Mg^{+2}$, $Ca^{+2}$, $Zn^{+2}$, $Ba^{+2}$, $Al^{+3}$ and combinations thereof that forms a salt with an inorganic or organic counter ion.

11. The inkjet recording medium of claim 10 wherein the multivalent metal salt is selected from the group consisting of $CaCl_2$, $MgCl_2$, $MgSO_4$, $Ca(NO_3)_2$, $Mg(NO_3)_2$, $ZnCl_2$, $Zn(NO_3)_2$, $AlCl_3$, $Al_2(OH)_5Cl$, $BaCl_2$, and $Ba(NO_3)_2$ and combinations thereof.

12. The inkjet recording medium of claim 11 wherein the multivalent metal salt comprises calcium chloride.

13. The inkjet recording medium of claim 1 wherein the inkjet-receptive coating comprises a first layer and a second layer wherein the second layer is disposed as a topcoat on the first layer.

14. The inkjet recording medium of claim 13 wherein the second layer comprises the multivalent metal salt.

15. The inkjet recording medium of claim 1 wherein the coating comprises cationic silica particles having a median particle size of about 0.2 to 0.5 microns, a calcium salt and polyvinyl alcohol.

16. The inkjet recording medium of claim 1 wherein the inkjet recording medium exhibits a gloss/mottle ratio of at least 100 when printed with an inkjet printer containing pigmented inks.

17. The inkjet recording medium of claim 16 wherein the inkjet recording medium exhibits a mottle of not over 1.0.

18. The inkjet recording medium of claim 1 wherein the gloss of the inkjet recording medium is at least 70.

19. The inkjet recording medium of claim 1 wherein the coated paper substrate comprises a fine particle size clay having a particle size distribution where at least 90% of the particles by weight have a particle size less than 2 μ.

20. The inkjet recording medium of claim 19 wherein the coated paper substrate comprises a carboxylated styrene butadiene copolymer latex binder.

21. The inkjet recording medium of claim 2 wherein the total pore volume of the particles as measured on a dry basis is about 0.7 to about 2.0 ml/g.

22. The inkjet recording medium of claim 21 wherein the total pore volume of the particles as measured on a dry basis is about 0.7 to about 1.5 ml/g.

23. The inkjet recording medium of claim 1 wherein the cationic porous silica is surface treated with aluminum chloride.

* * * * *